US008470100B2

(12) United States Patent
Finney et al.

(10) Patent No.: US 8,470,100 B2
(45) Date of Patent: Jun. 25, 2013

(54) COPPER ALLOYS AND HEAT EXCHANGER TUBES

(75) Inventors: M. Parker Finney, Lockport, NY (US); Larz Ignberg, Vasteras (SE); Claes Anders Kamf, East Amherst, NY (US); Timothy L. Goebel, Woodburn, KY (US); Ying Gong, Collierville, TN (US); Edward G. Rottmann, Bowling Green, KY (US)

(73) Assignee: Luvata Espoo Oy, Espoo (FI)

( * ) Notice: Subject to any disclaimer, the term of this patent is extended or adjusted under 35 U.S.C. 154(b) by 0 days.

(21) Appl. No.: 12/953,626

(22) Filed: Nov. 24, 2010

(65) Prior Publication Data

US 2011/0180244 A1 Jul. 28, 2011

Related U.S. Application Data

(60) Provisional application No. 61/264,529, filed on Nov. 25, 2009.

(51) Int. Cl.
*C22C 9/02* (2006.01)

(52) U.S. Cl.
USPC ..... 148/433; 420/472; 420/476; 165/177

(58) Field of Classification Search
USPC ..... 420/476, 472; 165/177; 148/433
See application file for complete search history.

(56) References Cited

U.S. PATENT DOCUMENTS

| | | | | |
|---|---|---|---|---|
| 4,935,076 | A * | 6/1990 | Yamaguchi et al. | 148/433 |
| 5,853,505 | A | 12/1998 | Brauer et al. | |
| 6,264,764 | B1 | 7/2001 | Kamf et al. | |
| 7,608,157 | B2 | 10/2009 | Oishi | |
| 2005/0247380 | A1 | 11/2005 | Rottmann | |

FOREIGN PATENT DOCUMENTS

| | | | |
|---|---|---|---|
| JP | 57145956 | A * | 9/1982 |
| JP | 63286544 | A * | 11/1988 |
| JP | 2290936 | A * | 11/1990 |
| JP | 05311295 | A * | 11/1993 |

* cited by examiner

*Primary Examiner* — Sikyin Ip
(74) *Attorney, Agent, or Firm* — Hodgson Russ LLP

(57) ABSTRACT

Alloys containing copper, iron, tin and, optionally, phosphorus or copper, zinc, tin and, optionally, phosphorus, which can be used in, for example, a copper alloy tube for heat exchangers that provides excellent fracture strength and processability for reducing the weight of the tube and for use in high pressure applications with cooling media such as carbon dioxide.

6 Claims, 4 Drawing Sheets

COPPER ALLOYS AND HEAT EXCHANGER TUBES

CROSS-REFERENCE TO RELATED APPLICATIONS

This application claims priority to U.S. provisional patent application No. 61/264,529, filed on Nov. 25, 2009, the disclosure of which is incorporated herein by reference.

FIELD OF THE INVENTION

The present invention pertains generally to copper alloys and use of the copper alloys in tubes for heat exchangers. Specifically, the invention pertains to high strength copper alloy tubes that have desirable pressure fracture strength and processability properties. The alloys are suitable to reduce thickness, and therefore, conserves material, for existing air conditioning and refrigeration (ACR) heat exchangers, and is suitable for use in a heat exchanger using a cooling medium such as $CO_2$.

BACKGROUND OF THE INVENTION

Heat exchangers for air conditioners may be constructed of a U-shaped copper tube bent like a hairpin and fins made from aluminum or aluminum alloy plate.

Accordingly, a copper tube used for the above type heat exchanger requires suitable conductivity, formability, and brazing properties.

HCFC (hydro-chlorofluorocarbon)-based fluorocarbons have been widely used for cooling media used for heat exchangers such as air conditioners. However, HCFC has a large ozone depleting potential such that other cooling media have been selected for environmental reasons. "Green refrigerants", for example, $CO_2$, which is a natural cooling medium, have been used for heat exchangers.

The condensing pressure during operation needs to be increased to use $CO_2$ as a cooling media to maintain the same heat transfer performance as HCFC-based fluorocarbons. Usually in a heat exchanger, pressures at which these cooling media are used (pressure of a fluid that flows in the heat exchanger tube) become maximized in a condenser (gas cooler in $CO_2$). In this condenser or gas cooler, for example, R22 (a HCFC-based fluorocarbon) has a condensing pressure of about 1.8 MPa. On the other hand, the $CO_2$ cooling medium needs to have a condensing pressure of about 7 to 10 MPa (supercritical state). Therefore, the operating pressures of the new cooling media are increased as compared with the operating pressure of the conventional cooling medium R22.

Due to the increased pressure and to some loss of strength due to brazing in some tube forming processes, conventional copper materials have to be made thicker thereby increasing the weight of the tube and therefore the material costs associated with the tube.

What is needed is a heat exchanger tube that has high tensile strength, excellent processability and good thermal conductivity that is suitable for reducing the wall thickness, and therefore, the material costs, for ACR heat exchangers and that is suitable for withstanding high pressure applications with new "green" cooling media such as $CO_2$.

BRIEF SUMMARY OF THE INVENTION

The present invention provides a copper alloy, for use in heat exchanger tubes, having, for example, high tensile strength, excellent processability and good thermal conductivity.

In an aspect the present invention is a copper alloy composition, which includes the following where the percentages are by weight. The composition comprises copper (Cu), iron (Fe) and tin (Sn). In an embodiment, the alloy has a composition of 99.6% copper by weight, 0.1% iron by weight and 0.3% tin by weight, represented as CuFe(0.1)Sn(0.3). In another embodiment, iron is present in the range of 0.02% to 0.2%, tin in the range of 0.07% to 1.0%, and the remainder includes Cu and impurities. The composition optionally comprises phosphorus in the range of 0.01% to 0.07%.

In another aspect the present invention is a copper alloy composition, which includes the following where the percentages are by weight. The composition comprises copper (Cu), zinc (Zn) and tin (Sn). In an embodiment, the alloy has a composition of 95.3% copper by weight, 4.0% zinc by weight and 0.7% tin by weight, represented as CuZn(4.0)Sn (0.7). In another embodiment, zinc is present in the range of 1.0% to 7.0%, tin in the range of 0.2% to 1.4%, and the remainder includes Cu and impurities. The composition optionally comprises phosphorus in the range of 0.01% to 0.07%.

In another aspect, the present invention provides tubes for ACR applications comprising a copper alloy composition. In yet another aspect of the present invention, the alloy composition is formed into tubes for ACR applications.

DETAILED DESCRIPTION OF THE INVENTION

Figure 1:
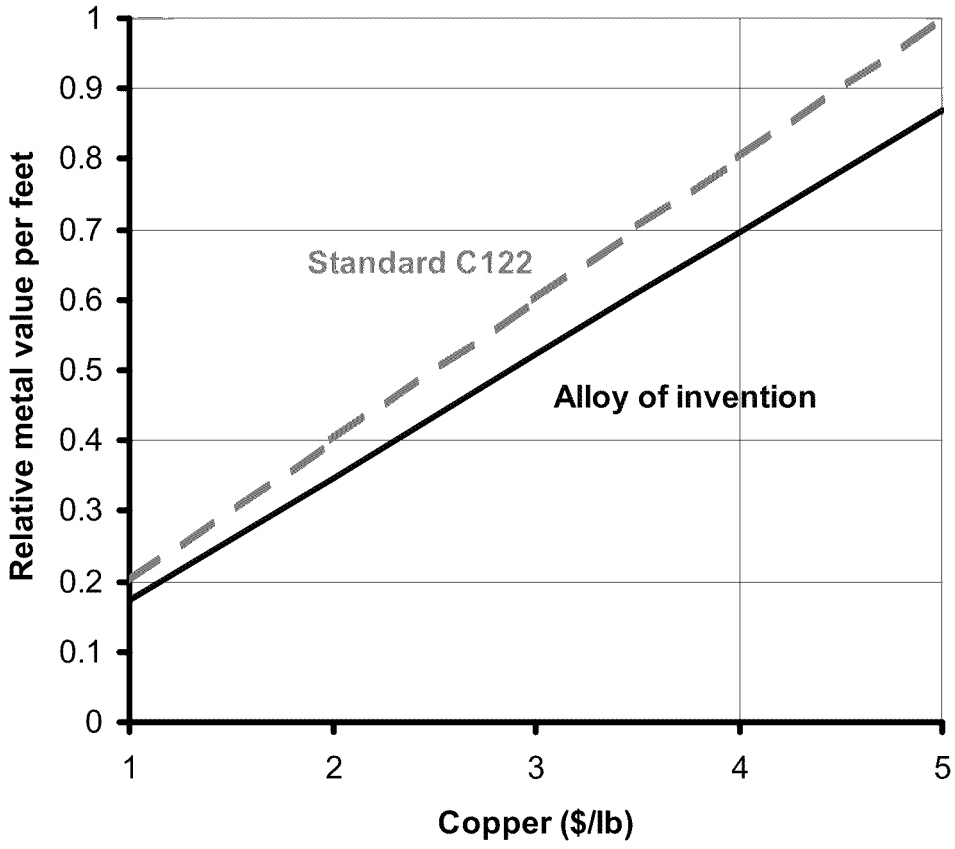
FIG. 1. Graphical representation of relative metal value per feet vs. copper price for a presently used alloy, C122, at standard wall thickness compared with an alloy of the present invention at reduced wall thickness.

The present invention provides a high strength alloy which can, for example, reduce the wall thickness and therefore reduce the cost associated with existing ACR tubing and/or provide ACR tubing capable of withstanding the increased pressures associated with cooling media such as $CO_2$. By, high strength it is meant that the alloy and/or tube made from the alloy has at least the levels of tensile strength and/or burst pressure and/or cycle fatigue failure set out herein. The copper alloy can provide savings in material, costs, environmental impact and energy consumption.

In order to provide a copper alloy for a heat exchanger tube, which can, for example, be used with cooling media such as $CO_2$, the selected alloy should have appropriate material properties and perform well with regard to processability. Important material properties include properties such as, for example, burst pressure/strength, ductility, conductivity, and cycle fatigue. The characteristics of the alloy and/or tube described herein are desirable so they can withstand ACR operating environments.

High tensile strength and high burst pressure are desirable tube properties because they define what operating pressure a tube can withstand before failing. For example, the higher the burst pressure, the more robust the tube design or for a given burst pressure minimum the present alloy allows for a thinner wall tube. A correlation exists between tensile strength and burst pressure. The alloy and/or tube comprising the alloy has, for example, a material tensile strength of a minimum of 38 ksi (kilo-pound per square inch). The material tensile strength can be measured by methods known in the art such as, for example, the ASTM E-8 testing protocol. In various embodiments, the alloy and/or tube comprising the alloy has a material tensile strength of 39, 40, 41 or 42 ksi.

Ductility of the alloy and/or a tube made from the alloy is a desirable property because, in an embodiment, tubes need to be bent 180 degrees into hairpins without fracturing or wrinkling for use in the coil. Elongation is an indicator of material ductility. The alloy and/or tube comprising the alloy has, for example, an elongation of a minimum of 40%. The elongation can be measured by methods known in the art such as, for example, the ASTM E-8 testing protocol. In various embodiments, the alloy and/or tube comprising the alloy has a minimum elongation of 41, 42, 43, 44, 45, 46, 47, 48, 49 or 50%.

Conductivity is a desirable property because it relates to heat transfer capability and therefore, it is a component of the efficiency of an ACR coil. Also, conductivity can be important for tube formation. The alloy and/or tube comprising the alloy has, for example, a conductivity of a minimum of 35% IACS. The conductivity can be measured by methods known in the art such as, for example, the ASTM E-1004 testing protocol. In various embodiments, the alloy and/or tube comprising the alloy has a minimum conductivity of 36, 37, 38, 39, 40, 45, 50, 55, 60 or 65% (IACS).

The alloy and/or tube has, for example, at least equal resistance to cycle fatigue failure as the current alloy in use, e.g., C122 as shown in Table 2. Further, it is desirable that the alloy and/or tube has, for example, at least equivalent resistance against one or more types of corrosion (e.g., galvanic corrosion and formicary corrosion) as the current alloy in use, e.g., C122.

In an embodiment, a tube comprising an alloy of the present invention has improved softening resistance (which can be important for brazing) and/or increased fatigue strength relative to a standard copper tube, e.g., a tube made from C122.

Figure 4A:
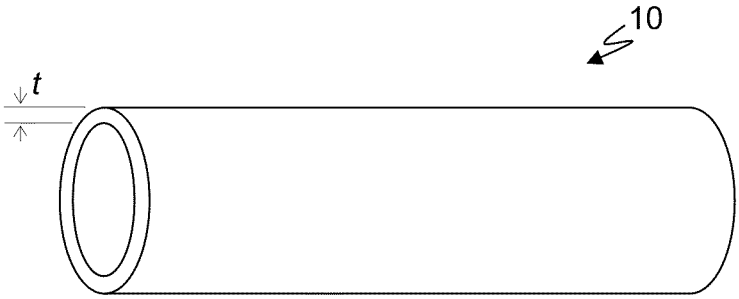
FIGS. 4(*a*)-(*c*). Graphical representation of various views of a tube according to an embodiment of the present invention. Figure (a) is a perspective view; Figure (b) is a cross-section of the tube of (a) as viewed along a longitudinal axis; and Figure (c) is a cross-section of the tube of (a) and (b) as viewed along an axis normal to the longitudinal axis.
Figure 4B:
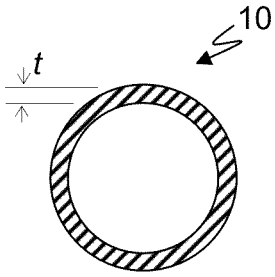
Figure 4C:
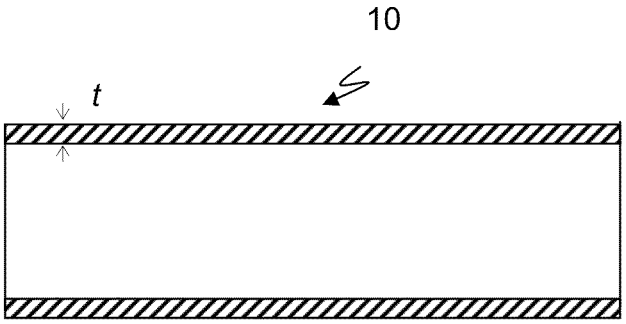

In an embodiment, a tube depicted in FIGS. 4(*a*)-(*c*) with reduced wall thickness t (relative to a tube comprising a conventional alloy, e.g., C122) comprising the present alloy has equal or improved burst pressure and/or cycle fatigue relative to tube comprising a conventional alloy, e.g., C122. For example, the tube wall thickness of a tube of the present invention is minimized relative to a standard tube, e.g. a C122 tube, which reduces total material cost, and both tubes exhibit the same burst pressure. In various embodiments, the tube wall thickness is at least 10, 15 or 20% less than a C122 tube, where both tubes have the same burst pressure. The burst pressure can be measured by methods known in the art such as, for example, CSA-C22.2 No. 140.3 Clause 6.1 Strength Test—UL 207 Clause 13. The cycle fatigue can be measured by methods known in the art such as, for example, CSA-C22.2 No. 140.3 Clause 6.4 Fatigue Test—UL 207 Clause 14.

The alloy of the present invention can be fabricated according to methods known in the art. During the alloy fabrication process and/or tube formation process, it can be important to control the temperature. Control of temperature can be important in keeping the elements in solution (preventing precipitation) and controlling grain size. For example, conductivity can increase and formability can suffer if processed incorrectly.

For example, to maintain both the desired grain size and prevent precipitate formation in the alloy fabrication and/or tube formation processes, heat treatment in the production process will occur over a short time such that the temperature of the alloy and/or tube will be between 400-600° C. with a rapid (e.g., 10 to 500° C./second) upward and downward ramping of the temperature.

It is desirable that alloy and/or tube made from the alloy have a desired grain size. In an embodiment, the grain size is from 1 micron to 50 microns, including all integers between 1 micron and 50 microns. In another embodiment, the grain size is from 10 microns to 25 microns. In yet another embodiment, the grain size is from 10 microns to 15 microns. The grain size can be measured by methods known in the art such as, for example, the ASTM E-112 testing protocol.

The alloy compositions of the present invention include the following where relative amounts of the components in the alloy are given as percentages by weight. The ranges of percentage by weight include all fractions of a percent (including, but not limited to, tenths and hundredths of a percent) within the stated ranges.

In an embodiment, the composition comprises copper, iron, tin, and, optionally, phosphorus. The iron is present in the range of 0.02% to 0.2%, and more specifically in the range of 0.07% to 0.13%; tin in the range of 0.07% to 1.0%, and more specifically in the range of 0.1% to 0.5%; and its remainder includes copper and impurities. In an embodiment, copper is present in the range of 98.67% to 99.91%. In an embodiment, the composition of the alloy is CuFe(0.1)Sn (0.3). In another embodiment, the composition of the alloy is CuFe(0.1)Sn(0.3)P(0.020).

The impurities can be, for example, naturally-occurring or occur as a result of processing. Examples of impurities include, for example, zinc, iron and lead. In an embodiment, the impurities can be a maximum of 0.6%. In various other embodiments, the impurities can be a maximum of 0.5, 0.45, 0.3, 0.2 or 0.1%.

Phosphorus is present, optionally, in the range of 0.01% to 0.07%, and more specifically in the range of 0.015% to 0.030%, or at 0.02%. Without intending to be bound by any particular theory, it is considered that inclusion of an appropriate amount of phosphorus in the alloy increases the weldability of the alloy by effecting the flow characteristics and oxygen content of the metal, while addition of too much phosphorus leads to poor grain structure and unwanted precipitates.

In an embodiment the composition consists essentially of Cu, Fe and Sn in the aforementioned ranges. In another embodiment the composition consists essentially of Cu, Fe, Sn and P in the aforementioned ranges. In various embodiments, addition of components other than copper, iron, tin (and phosphorus in the case of the second embodiment) does not result in an adverse change of greater than 5, 4, 3, 2 or 1% in properties of the alloys of the present invention such as, for example, burst pressure/strength, ductility, conductivity, and cycle fatigue.

In another embodiment, the composition of the alloy consists of Cu, Fe, Sn and P in the aforementioned ranges. In another embodiment, the composition of the alloy consists of Cu, Fe, Sn and P in the aforementioned ranges.

In an embodiment, the composition comprises copper, zinc, tin, and, optionally, phosphorus. The zinc is present in the range of 1.0% to 7.0%, and more specifically in the range of 2.5% to 5.5%; tin in the range of 0.2% to 1.4%, and more specifically in the range of 0.4% to 1.0%; and its remainder includes copper and impurities. In an embodiment, copper is present in the range of 91.47% to 98.8%. In an embodiment, the composition of the alloy is CuZn(4.0)Sn(0.7). In another embodiment, the composition of the alloy is CuZn(4.0)Sn (0.7)P(0.020).

The impurities can be, for example, naturally-occurring or occur as a result of processing. Examples of impurities include, for example, zinc, iron and lead. In an embodiment, the impurities can be a maximum of 0.6%. In various other embodiments, the impurities can be a maximum of 0.5, 0.45, 0.3, 0.2 or 0.1%.

Phosphorus is present, optionally, in the range of 0.01% to 0.07%, and more specifically in the range of 0.015% to 0.030%, or at 0.02%. Without intending to be bound by any particular theory, it is considered that inclusion of an appropriate amount of phosphorus in the alloy increases the weldability of the alloy by effecting the flow characteristics and oxygen content of the metal, while addition of too much phosphorus leads to poor grain structure and unwanted precipitates.

In an embodiment the composition consists essentially of Cu, Zn and Sn in the aforementioned ranges. In another embodiment the composition consists essentially of Cu, Zn, Sn and P in the aforementioned ranges. In various embodiments, addition of components other than copper, zinc, tin (and phosphorus in the case of the second embodiment) does not result in an adverse change of greater than 5, 4, 3, 2 or 1% in properties of the alloys of the present invention such as, for example, burst pressure/strength, ductility, conductivity, and cycle fatigue.

In another embodiment, the composition of the alloy consists of Cu, Zn, Sn and P in the aforementioned ranges. In another embodiment, the composition of the alloy consists of Cu, Zn, Sn and P in the aforementioned ranges.

The alloys of the present invention may be produced for use by various processes such as cast and roll, extrusion or roll and weld. The processing requirement includes, for example, brazeability. Brazing occurs when the tubes are connected as described below.

Generally, in the roll and weld process the alloy is cast into bars, roll reduced to thin gauge, heat treated, slit to size, embossed, formed into tube, welded, annealed, and packaged. Generally, in the cast and roll process the alloy is cast into "mother" tube, drawn to size, annealed, machined to produce inner grooves, sized, annealed, and packaged. Generally, in the extrusion process, the alloy is cast into a solid billet, reheated, extrusion pressed, drawn and grooved to final dimensions, annealed and packaged.

In an aspect the present invention provides tubes comprising a copper-iron-tin alloy or copper-zinc-tin alloy (described herein). In an embodiment, the tubes are from 0.100 inch to 1 inch in outer diameter, including all fractions of an inch between 0.100 inch and 1 inch, and have a wall thickness of from 0.004 inch to 0.040 inch, including all fractions of an inch between 0.004 and 0.040 inch. An advantage of the present invention is that thinner walled tubes can be used in ACR applications. This leads to reduced materials costs (see FIG. 1).

In an embodiment, the tubes comprising the copper-iron-tin alloy or copper-zinc-tin alloy (described herein) are used in ACR applications. It is desirable that the tubes have sufficient conductivity (e.g., so that the tubes can be joined by welding) and formability (e.g., ability to be shaped, e.g., bent, after formation of the tube). Also, it is desirable that the tubes have properties such that the tube can have internal groove enhancement.

An example of a process suited for the alloy of the present invention is a heat exchanger coil having tubes formed with a roll and weld process. In an initial step, a copper alloy of the present invention is cast into slabs followed by hot and cold rolling into flat strips. The cold rolled strips are soft annealed. The soft annealed copper alloy strips are then formed into heat exchanger tubes by means of a continuous roll forming and weld process. Before the roll forming and welding process the tubes may be provided with internal enhancements such as grooves or ribs on the inside wall of the tube as will be evident to those of ordinary skill in the art. The tubes are formed in a continuous roll and weld process and the output may be wound into a large coil. The large coil may then be moved to another area where the coil is cut into smaller sections and formed into the U or hairpin shape.

In order to construct a heat exchanger, the hairpin is threaded into through-holes of aluminum fins and a jig is inserted into the U-shaped copper tube to expand the tube, thereby closely attaching the copper tube and the aluminum fin to each other. Then the open end of the U-shaped copper tube is expanded and a shorter hairpin similarly bent into a U-shape is inserted into the expanded end. The bent copper tube is brazed to the expanded open end using a brazing alloy thereby being connected to an adjacent hairpin to make a heat exchanger.

The following Example is presented to further describe the present invention and is not intended to be in any way limiting.

Example 1

Copper alloys with different Fe and Sn contents were produced in pilot scale and mechanical and physical properties tested, see Table 1.

Figure 2:
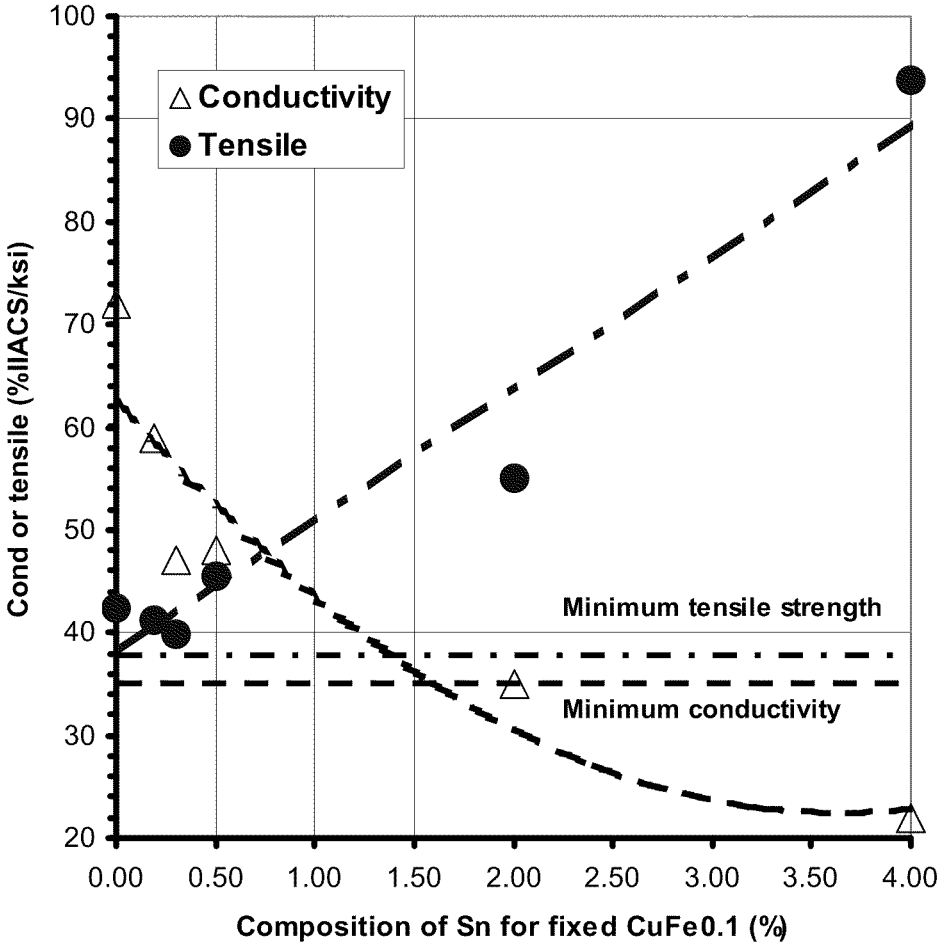
FIG. 2. Graphical representation of electrical conductivity and tensile strength of examples of copper-iron-tin alloys as a function of Sn content for CuFe0.1.

The results was plotted versus the amount of Sn at fixed Fe content, see FIG. 2. All tested alloys meet a desired minimum conductivity of 35% IACS. The reference alloys with 2 and 4% Sn shows that if the Sn content is >1.5% the conductivity is too low. The mechanical properties of a minimum tensile strength of 38 ksi is achieved for all tested alloys.

Material of a composition of 0.1% Fe and 0.3% Sn (CuFe (0.1)Sn(0.3) was produced in full production scale and formed to tubes using the roll and weld method. The tubes were produced both in standard wall thickness (e.g., 0.0118 inches) and with 13% lower wall thickness. Mechanical properties of the tubes were tested using ASTM and UL (e.g., UL testing protocols and compared with tubes made of "present use" copper alloy C12200 with standard wall thickness. The results are shown in Table 2. The alloy of the invention (CuFe (0.1)Sn(0.3)) has higher strength and higher burst pressure in standard wall thickness. For tubes produced with reduced wall thickness the burst pressure for an alloy of the present invention ((CuFe(0.1)Sn(0.3.)) is still higher compared with C122 at standard wall thickness.

TABLE 1

Mechanical properties and conductivity for tested alloys at different Fe and Sn contents.

| Alloy no | Fe (%) | Sn (%) | P (%) | TS Parallel (ksi) | E Parallel (%) | TS Transverse (ksi) | E Transverse (%) | Electrical Conductivity (% IACS) |
|---|---|---|---|---|---|---|---|---|
| A | 0.10 | 0 | 0.032 | 42.4 | 37.6 | 40.6 | 34.3 | 72 |
| B | 0.19 | 0 | 0.031 | 41.2 | 37.4 | 39.9 | 34.5 | 59 |
| C | 0 | 0.16 | 0.012 | 38.1 | 49.8 | 37.3 | 48.5 | 74 |
| D | 0 | 0.49 | 0.013 | 48.2 | 24.5 | 45.8 | 32.6 | 63 |
| E | 0 | 1.29 | 0.014 | 44.5 | 43.9 | 44.7 | 47.9 | 45 |
| F | 0.10 | 0.19 | 0.015 | 41.3 | 42.0 | 40.5 | 43.3 | 59 |
| G | 0.10 | 0.50 | 0.014 | 45.5 | 39.4 | 44.1 | 40.3 | 48 |
| Ref* | 0.10 | 2.0 | 0.03 | 55.1 | | | | 35 |
| Ref* | 0.10 | 4.0 | 0.03 | 63.8 | | | | 22 |

*Alloys C50715 and C51190 as reference only

TABLE 2

Mechanical properties of tubes made of an alloy of the invention (CuFe(0.1)Sn(0.3)) compared with current standard alloy C12200 (Cu-DHP).

| Alloy | Wall thickness of tube | Grain size (mm) | Tensile strength (ksi) | Elongation (%) | Burst pressure (psi) | Conductivity (% IACS) | Cycle Fatigue |
|---|---|---|---|---|---|---|---|
| CuFe0.1Sn0.3 | Standard | 0.010 | 39.8 | 43 | 2370 | 47 | Pass |
| CuFe0.1Sn0.3 | 87% of standard | 0.010 | 39.6 | 46 | 2040 | 47 | Pass |
| C12200 | Standard | 0.020 | 34.7 | 47 | 1950 | 83 | Pass |

Example 2

Copper alloys with different Zn and Sn contents were produced in pilot scale and mechanical and physical properties tested, see Table 3.

Figure 3:
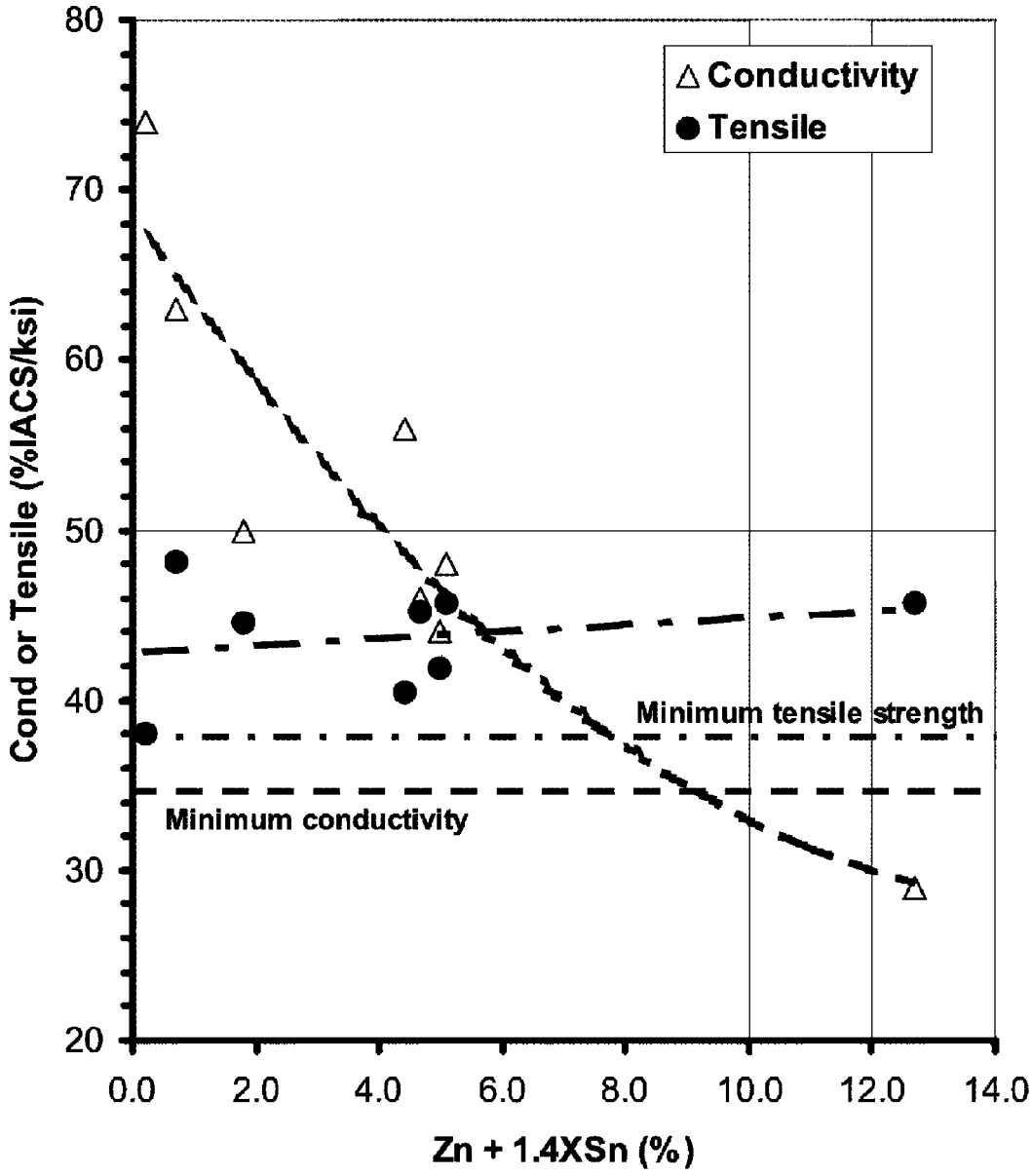
FIG. 3. Graphical representation of electrical conductivity and tensile strength of examples of copper-zinc-tin alloys as a function of Zn and Sn (×1.4) contents.

The results were plotted versus the amount of Zn and Sn, see FIG. 3. It is considered that Sn has a greater influence than Zn on conductivity and strength, therefore the Sn content was multiplied by 1.4 in FIG. 3. All tested alloys, except alloy 0, meet a desired minimum conductivity of 35% IACS. The mechanical properties of a minimum tensile strength of 38 ksi is achieved for all tested alloys.

Material of a composition of 4.0% Zn and 0.7% Sn (CuZn(4.0)Sn(0.7)) was produced in full production scale and formed to tubes using the roll and weld method. The tubes were produced both in standard wall thickness (e.g., 0.0118 inches) and with 13% lower wall thickness. Mechanical properties of the tubes were tested using ASTM and UL (e.g., UL testing protocols and compared with tubes made of "present use" copper alloy C12200 with standard wall thickness. The results are shown in Table 4. The alloy of the invention (CuZn(4.0)Sn(0.7)) has higher strength and higher burst pressure in standard wall thickness. For tubes produced with reduced wall thickness the burst pressure for an alloy of the present invention (CuZn(4.0)Sn(0.7)) is still higher compared with C122 at standard wall thickness.

TABLE 3

Mechanical properties and conductivity for tested alloys at different Zn and Sn contents.

| Alloy no | Zn (%) | Sn (%) | P (%) | TS Parallel (ksi) | E Parallel (%) | TS Transverse (ksi) | E Transverse (%) | Electrical Conductivity (% IACS) |
|---|---|---|---|---|---|---|---|---|
| H | 0 | 1.29 | 0.032 | 44.5 | 43.9 | 44.7 | 47.9 | 50 |
| I | 0 | 0.49 | 0.014 | 48.2 | 24.5 | 45.8 | 32.6 | 63 |
| J | 0 | 0.16 | 0.012 | 38.1 | 49.8 | 37.3 | 48.5 | 74 |
| K | 3.96 | 0.5 | 0.015 | 45.2 | 41.3 | 47.5 | 36.5 | 46 |
| L | 3.69 | 1.0 | 0.015 | 45.7 | 48.4 | 44.7 | 46.6 | 48 |
| M | 4.02 | 0.68 | 0.005 | 41.9 | 45.0 | — | — | 44 |
| N | 4.41 | 0 | 0.015 | 40.5 | 44.0 | 39.7 | 47.1 | 56 |
| O | 10.8 | 1.35 | 0.001 | 45.7 | 43.0 | — | — | 29 |

TABLE 4

Mechanical properties of tubes made of an alloy of the invention (CuZn(4)Sn(0.7)) compared with current standard alloy C12200 (Cu-DHP).

| Alloy | Wall thickness of tube | Grain size (mm) | Tensile strength (ksi) | Elongation (%) | Burst pressure (psi) | Conductivity (% IACS) | Cycle Fatigue |
|---|---|---|---|---|---|---|---|
| CuZn4.0Sn0.7 | Standard | 0.015 | 41.9 | 45 | 2455 | 44 | Pass |
| CuZn4.0Sn0.7 | 87% of standard | 0.010 | 40.7 | 50 | 2180 | 44 | Pass |
| C12200 | Standard | 0.020 | 34.7 | 47 | 1950 | 83 | Pass |

While the invention has been particularly shown and described with reference to specific embodiments, it should be understood by those having skill in the art that various changes in form and detail may be made therein without departing from the spirit and scope of the present invention as disclosed herein.

What is claimed is:

1. An ACR tube for use in a heat exchanger, wherein the tube comprises a copper alloy consisting of:

a) zinc at 4.0% by weight;

b) tin at 0.7% by weight; and c) optionally, phosphorus at 0.01 to 0.07% by weight, wherein the remainder of the alloy is copper.

2. The ACR tube of claim 1, wherein the alloy has a grain size of from 1 micron to 50 microns.

3. The ACR tube of claim 1, wherein the tube has an outer diameter of from 0.100 inch to 1 inch.

4. The ACR tube of claim 1, wherein a wall thickness of the tube is minimized relative to a wall thickness of a standard C122 tube to reduce total material cost, and wherein each of the tube and the standard C122 tube exhibit substantially a same burst pressure.

5. The ACR tube of claim 4, wherein the wall thickness of the tube is at least 10% less than the wall thickness of the standard C122 tube.

6. An ACR tube for use in a heat exchanger, wherein the tube comprises a copper alloy consisting of:

a) zinc at 4.0% by weight;

b) tin at 0.7% by weight; and c) optionally, phosphorus at 0.01 to 0.07% by weight, wherein naturally-occurring impurities or impurities occurring as a result of processing are a maximum of 0.6% by weight and the remainder of the alloy is copper.

* * * * *